United States Patent [19]

Sudholt

[11] 3,998,200

[45] Dec. 21, 1976

[54] RECIPROCATING ENGINE

[76] Inventor: Kenneth J. Sudholt, 3801 Fair Oaks Drive, Granite City, Ill. 62040

[22] Filed: Oct. 16, 1974

[21] Appl. No.: 515,190

[52] U.S. Cl. ..... 123/197 R; 74/43; 74/44

[51] Int. Cl.[2] ..... F02B 75/32

[58] Field of Search ... 123/197 R, 197 AB, 197 AC; 74/43, 44, 49, 50, 51

[56] References Cited

UNITED STATES PATENTS

| | | | |
|---|---|---|---|
| 1,312,585 | 8/1919 | Shepherd | 123/197 R |
| 1,567,172 | 12/1925 | Powell | 123/197 R |

FOREIGN PATENTS OR APPLICATIONS

| | | | |
|---|---|---|---|
| 1,526,438 | 5/1970 | Germany | 123/197 |
| 283,053 | 2/1931 | Italy | 123/197 |
| 678,677 | 9/1952 | United Kingdom | 123/197 |

*Primary Examiner*—Charles J. Myhre
*Assistant Examiner*—William C. Anderson
*Attorney, Agent, or Firm*—Gravely, Lieder & Woodruff

[57] ABSTRACT

An engine includes a block having at least one cylinder in which a piston reciprocates. The piston is connected through a piston connecting rod to a lever arm, and the lever arm is in turn connected to the eccentric crank pin of a crankshaft through a crank connecting rod. The lever arm is positioned and moved not only by the piston and crankshaft, but also by a positioning cam which bears against one end of the arm. The arrangement is such that throughout the entire power stroke the force transmitted to the crankshaft is applied through a relatively large moment arm, thus providing greater torque for the engine. The arrangement results in a relatively large angle between the crank connecting rod and the crank arm and permits greater eccentricity on the crank arm.

8 Claims, 7 Drawing Figures

RECIPROCATING ENGINE

BACKGROUND OF THE INVENTION

This invention relates in general to engines and more particularly to reciprocating engines of various styles.

In the conventional piston-type internal combustion engine, a combustible mixture is burned within a cylinder and forces a piston through the cylinder. The force applied to the piston is transmitted to the crank pin of a crankshaft through a single connecting rod. In this arrangement the force is applied over 180° of rotation for the crankshaft and hence the power stroke of the engine is said to last for 180°.

During much of the power stroke the angle between the connecting rod and crank arm on the crankshaft is quite small and as a result a very small moment arm exists. Of course, when the moment arm is small very little torque is applied to the crankshaft. Indeed, only when the connecting arm is disposed at 90° with respect to the crank arm is maximum torque applied to the crankshaft, and while the application of torque is quite high at 45° on either side of that position, any position beyond the 45° position does not result in a very efficient application of torque.

SUMMARY OF THE INVENTION

One of the principal objects of the present invention is to provide a piston-type engine in which the force on the piston is transmitted to the crankshaft such that greater torque is applied to the crankshaft. Another object is to provide an engine of the type stated in which the power stroke of the piston takes place during about 90° travel for the crankshaft and during that 90° movement the connecting rod for the crankshaft applies force through a relatively large moment arm. A further object is to provide an engine of the type stated which is highly efficient. An additional object is to provide an engine of the type stated which may be of the internal combustion variety or compressed gas variety. These and other objects and advantages will become apparent hereinafter.

The present invention is embodied in an engine having a block provided with a cylinder in which a piston reciprocates. A crankshaft is extended through the block and the piston is connected with the crankshaft through means which transfers the force of the power stroke to the crankshaft through a relatively larger moment arm throughout substantially the entire power stroke. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
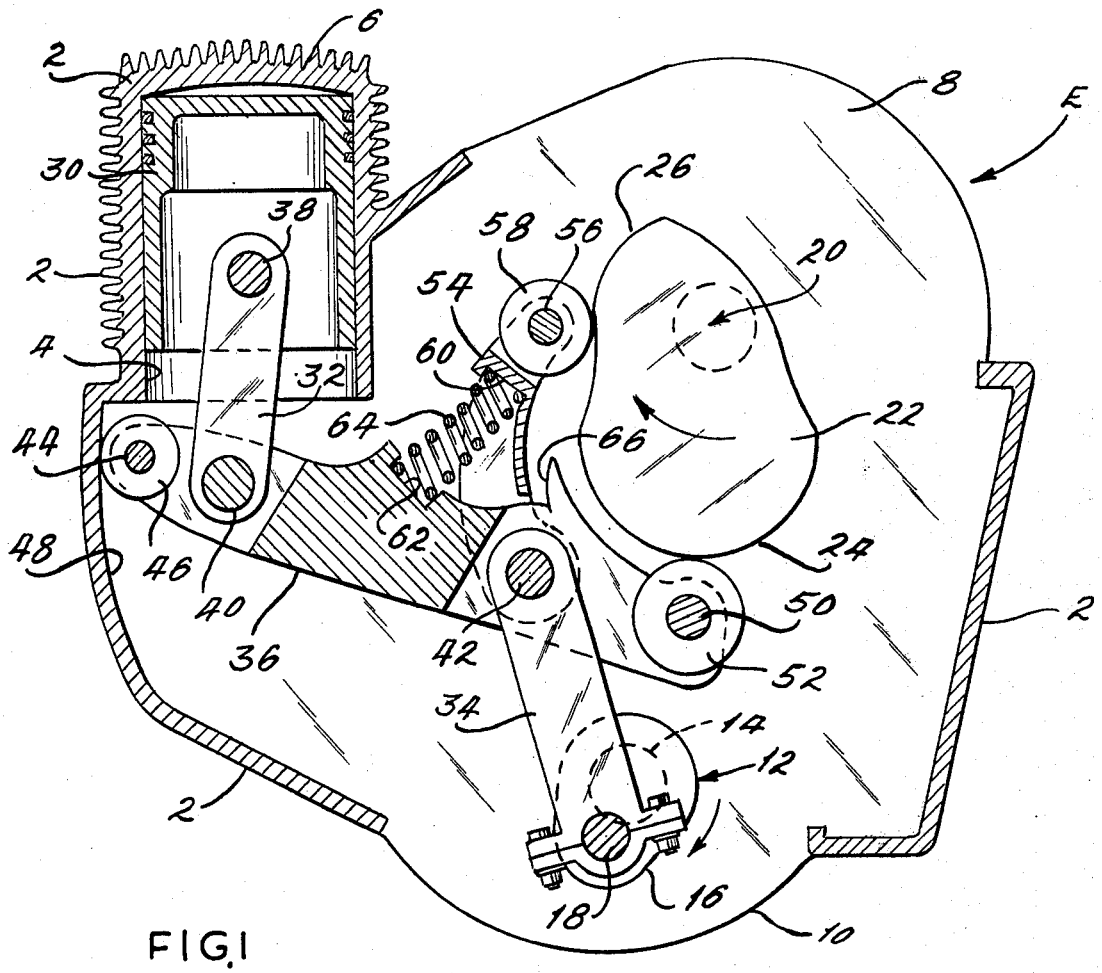
FIG. 1 is a sectional view of an internal combustion engine constructed in accordance with and embodying the present invention, the engine being at the end of its exhaust stroke and the beginning of its intake stroke.

Referring now to the drawings (FIG. 1), an internal combustion engine E includes a block 2 having a cylinder 4 therein. One end of the cylinder 4 is closed by a head 6, while the other end opens into the hollow interior of the block 2. The upper portion of the block 2 is closed by a domed cover 8, while the lower portion is closed by a crank case 10 which is offset laterally with respect to the cylinder 4.

Extended through the lower portion of the block 2 directly above the crank case 10 is a crankshaft 12 which includes the usual journals 14, crank arms 16, and a crank pin 18 located at the ends of the arms 16. The journals 14 are received in bearings mounted in the block 2 and hence the axis of rotation for the crankshaft 12 is the axis of the journals 14. The crank pin 18 is eccentric to that axis.

Directly above the crankshaft 12, a cam shaft 20 likewise extends through the block 2, and this shaft is journaled within bearings set into the block 2 above the crankshaft bearings. Thus, the crankshaft 12 and the cam shaft 20 rotate about parallel axes with both of the axes being located to the side of the cylinder 4. The cam shaft 20 is geared to the crankshaft 12 with the gear ratio being 1:1 so that the cam shaft 20 makes a complete revolution for every revolution of the crankshaft 12. The cam shaft 20 carries a cam 22 having two lobes 24 and 26 with the latter being a greater distance from the axes of rotation than the former.

The cylinder 4 contains a piston 30 which moves to and fro therein. The reciprocating motion is generated by the presence of high pressure gas in the cylinder 4 and that gas may be either introduced directly into the cylinder or may be derived from the ignition and burning of a combustible mixture within the cylinder 4. In any event, the high pressure gas forces the piston 30 away from the head 6.

The reciprocating movement of the piston 30 within the cylinder 4 and the rotational movement of the crankshaft 12 and cam shaft 20 are all tied together through a linkage system or connecting means including a piston connecting rod 32 connected with the piston 30, a crank connecting rod 34 connected with the crankshaft 12, and a lever arm 36 connected to both the connecting rods 32 and 34 and positioned by the cam 22. More specifically, the piston connecting rod 32 extends upwardly into the interior of the piston 30 where it is connected thereto by a wrist pin 38. The lower end of the piston connecting rod 32 is connected to the lever arm 36 by a cross pin 40 located somewhat inwardly from the end of the arm 36. The lower end of the crank connecting rod 34 fits around the crank pin 18 on the crankshaft 12 and therefore moves in a circular path about the axis of rotation for the crankshaft 12. The upper end of the crank connecting rod 34 is connected by another cross pin 42 to the lever arm 36 somewhat inwardly from the other end of the lever arm 36.

At its piston end, that is the end to which the piston connecting rod 32 is connected, the lever arm 36 is provided with a pin-type journal 44 about which a roller 46 revolves. The roller 46 follows or rolls along a guide surface 48 on the block 2 immediately below the cylinder 4 therein. The crank end of the lever arm 36, that is the end to which the crank connecting rod 34 is connected, has another pin-type journal 50 about which a cam follower or roller 52 revolves. The roller 52 follows the surface of the cam 22 and thus enables the cam 22 to change the angular disposition of the lever arm 36.

Not only does the cross pin 42 connect the crank connecting rod 34 to the lever arm 36, but it also serves as a journal for a restraining arm 54 which extends upwardly therefrom in an arcuate configuration. At its upper end, the restraining arm 54 has a pin-type journal 56 about which another cam roller 58 revolves. Directly behind the roller 58 the arm 54 has a socket-like spring seat 60 which is located directly opposite to a similar spring seat 62 on the lever arm 36 between the two cross pins 40 and 42 thereon. The seats 60 and 62 anchor the ends of a compression-type coil spring 64 which extends between them and urges the cam roller 58 toward the cam 22. This prevents the cam follower 52 from moving away from the cam 22 and the roller 46 from lifting off the guide surface 48, and further enables cam 22 to move the piston 30 downwardly. The lever arm 36 has an abutment 66 which limits the amount the restraining arm 54 may move toward the cam 22 and indeed enables the cam 22 to move away from the roller 58.

The intake of gases into and exhaust of gases from the cylinder 4 of the engine E are quite similar to conventional engines using valves in the heads thereof or ports in the cylinders thereof or both. If valves are used, the cam shaft 20 may be provided with additional lobes for operating the valves. In the alternative, a separate cam shaft may be employed. The cylinder head 6 may be fitted with a spark plug which ignites the gases in the cylinder 4 in the usual manner, or it may be fitted with an injector, in which case the gases may be ignited through the effects of compression such as in a diesel engine.

OPERATION

In operation, the piston 30 reciprocates twice for every single revolution of the crankshaft 12 and the cam shaft 20. In so doing the piston 30 undergoes the usual intake, compression, power, and exhaust strokes.

At the beginning of the intake stroke (FIG. 1) the piston 30 is at the top of its cylinder 4 and the intake valve just begins to open. The crank pin 18 on the crankshaft, moreover, is located beyond its lowermost or bottom-center position, while the high lobe 24 on the cam 22 is directed downwardly, urging the crank end of the lever arm 36 downwardly just about as far as it will go. In effect, the cross pin 42 serves as a fulcrum for the arm 36 so that when the cam 22 forces the crank end downwardly, the piston end rises and drives the piston 30 to the top of the cylinder 4.

At the beginning of the intake stroke (FIG. 1) the intake valve opens and during the stroke (FIGS. 1 and 2) the piston 30 moves downwardly away from the head 6. As a result, a combustible charge is drawn into the portion of the cylinder 4 vacated by the piston 30. The intake stroke ends before the crankshaft 12 reaches top center and during this rotation, the crank pin 18 moves upwardly. The crank connecting rod 34 likewise moves upwardly and drives that portion of the lever arm 36 to which it is connected upwardly. The cam 22 rotates and during this part of cam rotation the roller follower 52 moves off of the lobe 24 toward the axis of rotation for the cam shaft 20. As a result, the crank end of the lever arm 36 moves upwardly, while the piston end moves downwardly. Indeed, the spring 64 forces the piston end of the lever arm 36 downwardly, and as it moves downwardly the roller 46 moves along the guide surface 48 on the block 2. Of course, as the piston end of the lever arm 36 moves downwardly, it pulls the piston 30 through the cylinder 30 to the lower end thereof.

Figure 2:
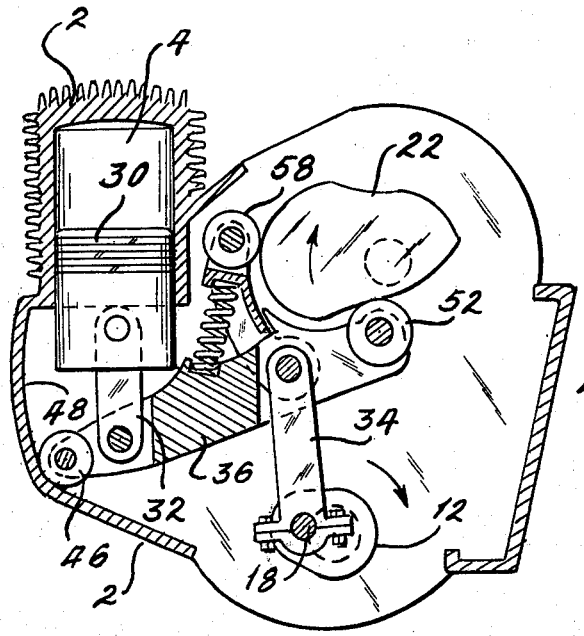
FIG. 2 is a sectional view showing the engine at the end of its intake stroke and beginning its compression stroke.
Figure 3:
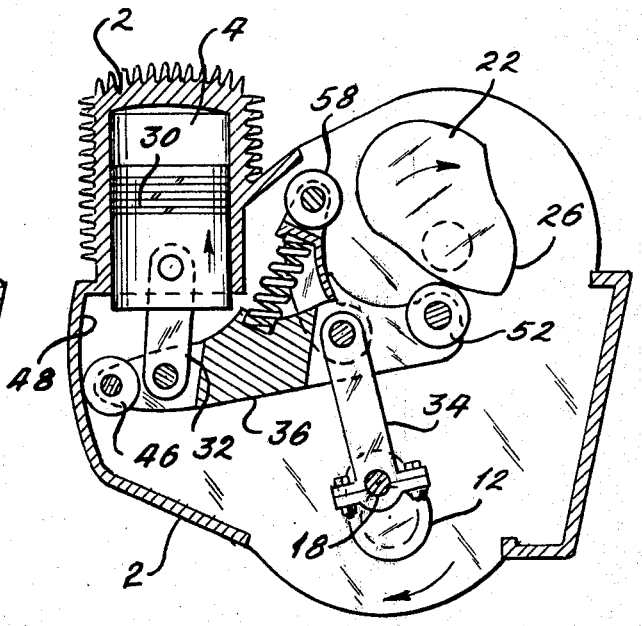
FIG. 3 is a sectional view showing the engine midway through its compression stroke.
Figure 4:
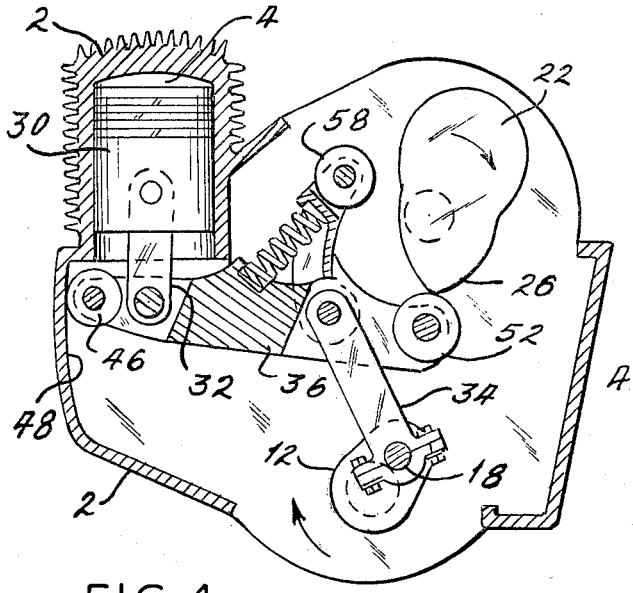
FIG. 4 is a sectional view showing the engine at the end of its compression stroke and at the beginning of its power stroke.

The compression stroke (FIGS. 2, 3 and 4) follows the intake stroke and during this stroke the piston 30 moves back toward the head 6 with both valves being closed. As a result, the combustible mixture is compressed within the upper portion of the cylinder 4. During the compression strike the crankshaft 12 moves from a position in which the crank pin 18 is before top center (FIG. 2) to a position in which the crank pin 18 is beyond top center (FIG. 4), while the roller follower 52 moves over the low portion of the cam 22 and up onto the low lobe 26. In so doing, the crank end of the lever arm 36 moves downwardly and this coupled with the generally upward movement of the crank connecting rod 34 forces the piston end of the lever arm 36 upwardly. The end result is that the piston 30 moves from the bottom of the cylinder 4 (FIG. 2) to the top of the cylinder 4 (FIG. 4). The longitudinal position of the lever arm 36 is controlled by the roller 46 which continues to move over the guide surface 48. The spring 64 serves no purpose during the compression stroke, for the abutment 66 holds the restraining arm 54 and roller 58 thereon away from the surface of the cam 22 so that the spring 64 does not exert any force on the lever arm 36.

Figure 5:
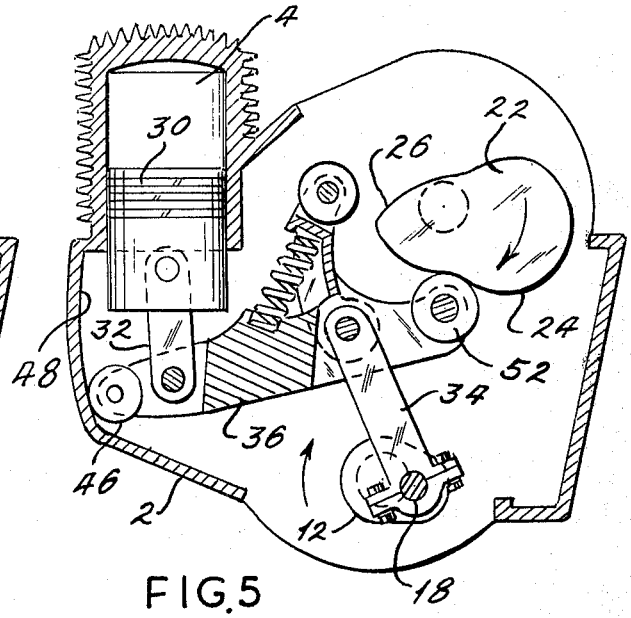
FIG. 5 is a sectional view showing the engine at the end of its power stroke and the beginning of its exhaust stroke.

As the piston nears the head 6 at the end of the compression stroke (FIG. 4), the combustible mixture ignites, causing it to burn and increase in pressure. The pressure increase forces the piston 30 downwardly through its power stroke (FIGS. 4 to 5) and this forces the piston end of the lever arm 36 downwardly. Both valves remain closed during the power stroke. During the power stroke the cam 22 rotates and moves along the roller 58 from the low lobe 26 toward the high lobe 24. In this interval the surface of the cam 22 which is contacted by the roller follower 52, remains at about constant radius so the adjacent crank end of the lever arm 36 neither moves upwardly or downwardly. Indeed, that end acts as a fulcrum so that the downward movement of the other end of the lever arm 36 is transmitted to the crank pin 18 with a substantial increase in mechanical advantage. The power stroke begins at a position in which the crank pin 18 is substantially beyond top center (FIG. 4) and ends with the crank pin substantially ahead of bottom center (FIG. 5). Within this range the angle between the crank arms 16 and the crank connecting rod 34 is quite large, thus providing a large moment arm which in turn enables additional torque to be applied to the crankshaft 12. Also, the arrangement permits use of crank arms 16 of extended length, and this further increases the available torque. This is in contrast to the typical reciprocating engine where the power stroke lasts for 180° of crankshaft rotation, with the angle between the crank arms and connecting rod being quite small for much of the stroke and the crank arms being quite short. As a result, a small moment arm exists in the typical engine for much of the power stroke with low torque being applied to the crankshaft. The abutment 66 holds the restraining arm 54 and its roller 58 away from the cam 22 so the spring 64 does not exert any force on the lever arm 36 during the power stroke.

The exhaust stroke (FIGS. 5 to 1) which follows the power stroke, moves the piston 30 back up to its original position (FIG. 1), that is to the position next to the head 6 where the intake stroke began. As the piston 30 moves through the cylinder 4, the exhaust valve is open and consequently the cylinder 4 is purged of the products of combustion remaining after the power stroke. During the exhaust stroke, the crankshaft 12 moves from a position in which the crank pin 18 is ahead of bottom center (FIG. 5) to a position in which the crank pin 18 is beyond bottom center (FIG. 1). Thus, the crank connecting rod 34 moves downwardly and then upwardly. At the same time, the cam 22 moves along the roller follower 52 to the cam surface of greatest radius on the high lobe 24. Consequently, the crank end of the lever arm 36 is depressed substantially by the cam 22 so as to drive the other end of the lever arm 36 upwardly which in turn drives the piston 30 upwardly. In other words, the lever arm 36 pivots about the cross pin 42 so that as its crank end goes down, its piston end rises. The roller 46 continues to roll along the guide surface 48 and stabilizes the lever arm 36 in its longitudinal direction. Moreover, as the high lobe 24 rises over the follower roller 52 for the lever arm 36 it thereafter comes against the roller 58 on the restraining arm 54 and drives that arm backwardly, compressing the spring 24 at it does.

The engine is now in condition for another cycle identical to that just described, and indeed the cycles repeat providing uniform rotation to the crankshaft 12.

The engine E operates at relatively low speed and has a relatively heavy flywheel. Its operating characteristics to a limited extent can be changed by varying the shape of the cam 22. For example, the radius of the cam 22 can increase as the power stroke progresses, and this has the effect of lengthening the amount of crankshaft rotation occupied by the power stroke. Of course, more than one cylinder 4 may be arranged in a common block to provide a multicylinder version of the engine E.

MODIFICATIONS

Figure 6:
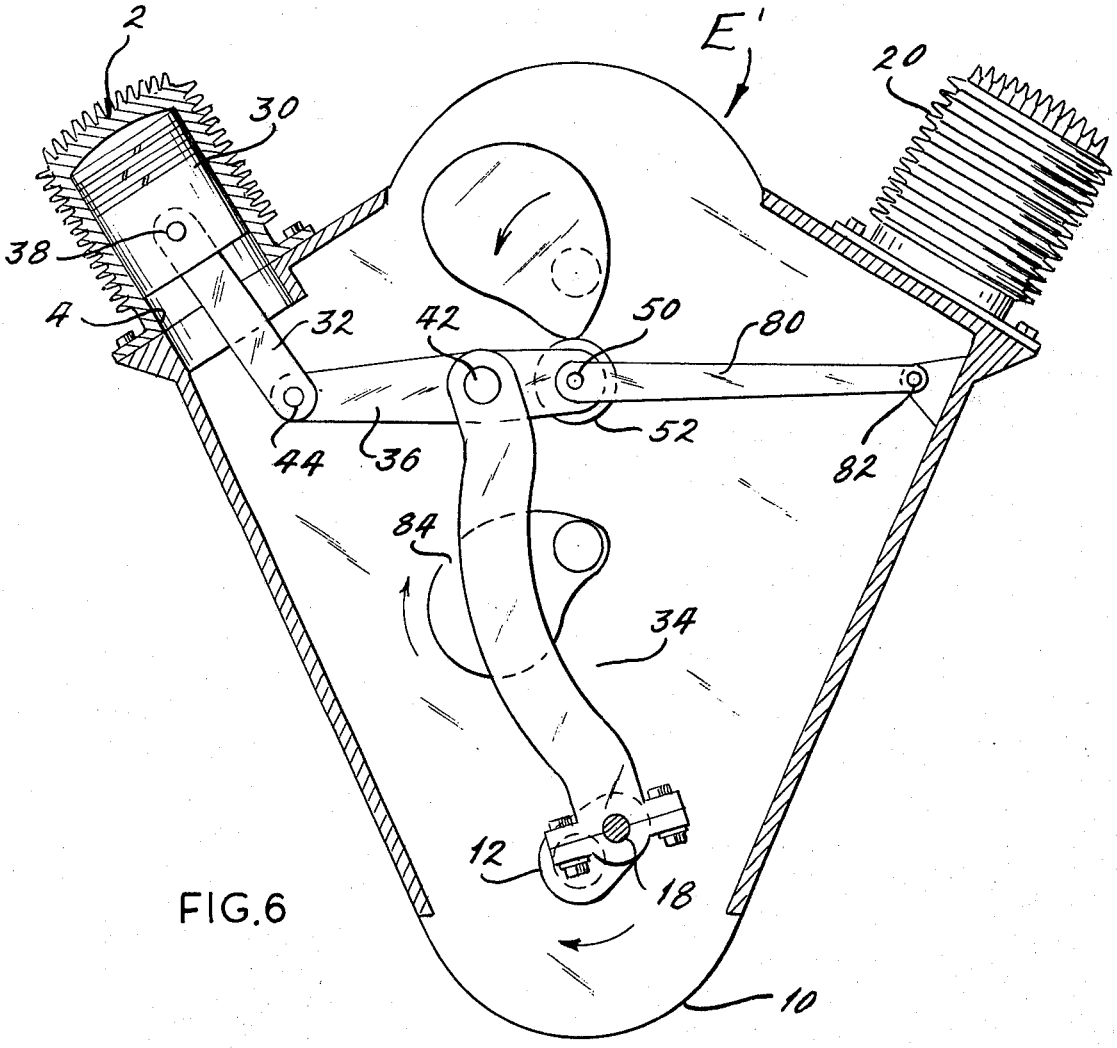
FIG. 6 is a sectional view of a modified engine with a V-type cylinder arrangement.

A modified engine E (FIG. 6) utilizes the principle of the engine E and has a crankshaft 12, a piston 30, piston and crank connecting rods 32 and 34 respectively, a lever arms 36 and a cam 20. The lever arm 36, however, is stabilized in the longitudinal direction by a positioning link 80 which extends from the pin-type journal 50, about which it pivots, to another pivot pin 82 on the opposite side of the block 2 from the piston 30, thereby eliminating the head for the roller 46 and glide surface 48. Moreover, engine E′, in addition to the main cam 22, has a back-up cam 84 which rotates at a 1:1 ratio with respect to the main cam 22 and serves the purpose of the spring 64 in the engine E, that is it moves the piston 30 downwardly during the intake stroke and prevents hammering, all by maintainng the roller follower 52 in contact with the surface of the cam 22.

Figure 7:
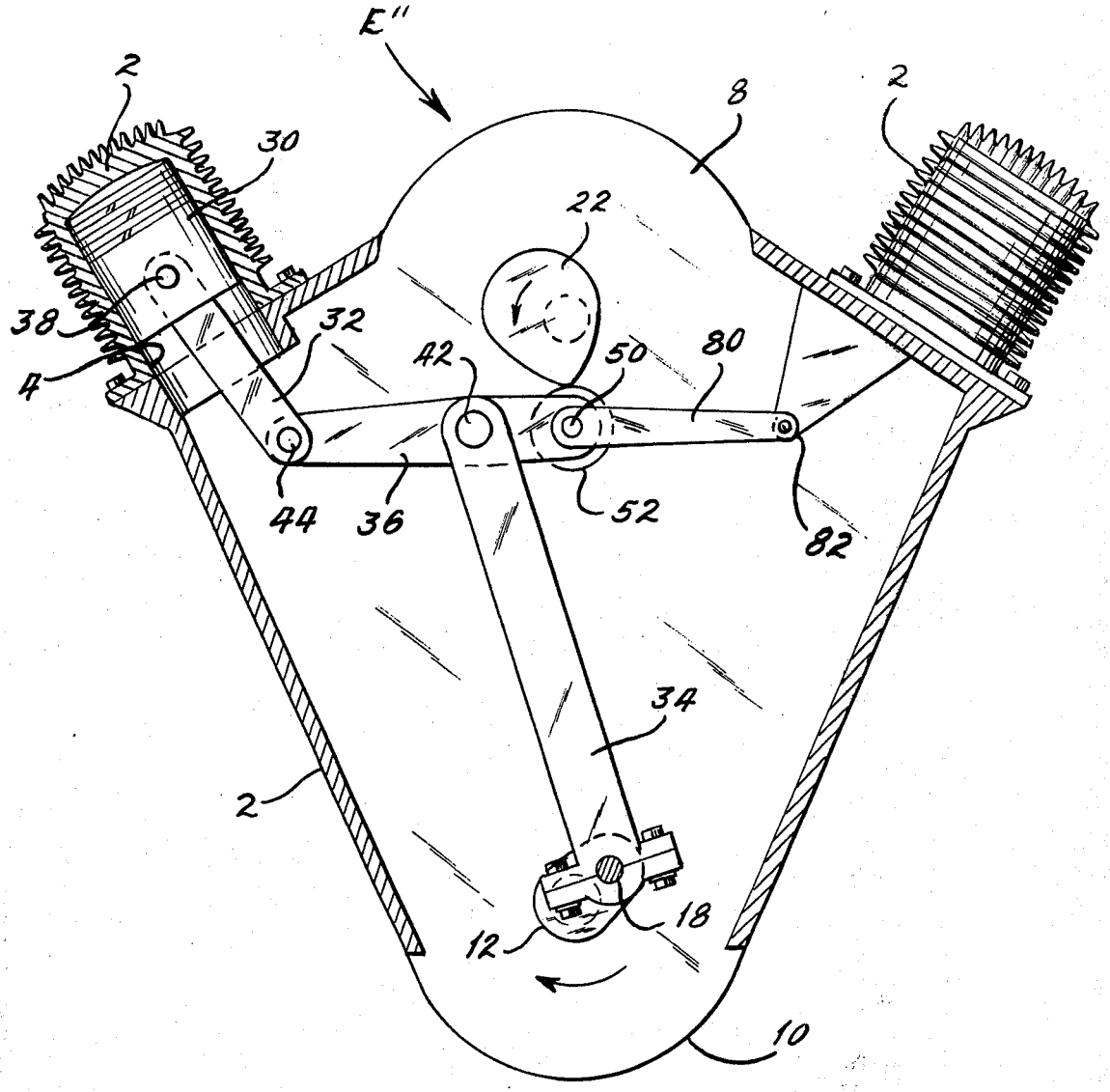
FIG. 7 is a sectional view of still another modified engine of the two stroke variety.

The engines E and E′ are the four stroke variety, that is four strokes of the piston 30 are necessary to complete a full cycle. Still another modified engine E″ (FIG. 7) operates on the two-stroke principle. The engine E″ differs from the engines E and E′ in that its cam 22″ is somewhat different in configuration than the cam 22. In particular, the cam 22″ does not have a high lobe 24 as does the cam 22. Also, the intake gases are pressurized. When the piston 30 of the engine E″ reaches the bottom of its power stroke it will remain in that position while the exhaust valve or port and the intake valve or port are open. This enables the spent gases to escape from the cylinder 4 and the pressurized intake gases to enter. At about 270° beyond top center for the crank pin 18, the piston 30 begins to rise through the cylinder and compress the intake gas trapped in the cylinder 4. Near the top of the compression stroke the trapped and compressed gases will be ignited, thus driving the piston 30 downwardly through another power stroke. No need exists in the engine E″ for the spring seat 60 and 62, journal 56, abutment 66, spring 64, restraining arm 54 and roller 58 or for the back-up cam 84 since a force is always acting on the piston 4 such that it is urged away from the head 6. This force keeps the roller follower 52 in contact with the cam 22″.

Maximum torque is derived by changing the design of the cam 22″ so that the crankshaft 12 rotates just a few degrees when the crank pin 18 thereof is in the vicinity of 90° beyond top center. Hence, power is applied when the moment arm is greatest.

While the engines E, E′ and E″ are of the internal combustion variety, with a change in the valve timing the principles of the present invention may be utilized with compressed gas engines.

This invention is intended to cover all changes and modifications of the example of the invention herein chosen for purposes of the disclosure which do not constitute departures from the spirit and scope of the invention.

What is claimed is:

1. An engine comprising: a block having at least one cylinder; a piston movable axially in the cylinder through a power stroke and other strokes; a crankshaft rotatable in the block; linkage means between piston and the crankshaft for coupling the two together such that crankshaft rotates in a predetermined relation to the axial reciprocating movement of the piston in the cylinder, the linkage means including a lever arm, a piston connecting rod extended between the piston and the lever arm and being pivotally connected to the lever arm, and a crank connecting rod pivotally connected to the lever arm and to the crankshaft in offset relation to the axes of rotation thereof; and positioning means acting on the lever arm of the linkage means to position the linkage means such that a full stroke of the piston is translated into less than 180° of rotational movement for the crankshaft, the positioning means including a cam which rotates in predetermined relation to the crankshaft and bears against the lever arm beyond the location where the connecting rod is pivotally connected to the lever arm and such that the connecting rod is pivotally connected to the lever arm between the pivotal connection of the piston connecting rod to the lever arm and the point at which the cam bears against the lever arm.

2. An engine according to claim 1 wherein the crank connecting rod is pivotally connected to the lever arm between the pivotal connection of the piston connecting rod to the lever arm and the point at which the cam bears against the lever arm.

3. An engine according to claim 2 wherein the power stroke is followed by an exhaust stroke in which the piston moves in an opposite direction and wherein the cam moves the piston in said opposite direction.

4. An engine according to claim 3 wherein the exhaust stroke is followed by an intake stroke in which the piston moves in the same direction as during the power stroke, and further comprising means for maintaining the lever arm in contact with the cam as the piston moves through its intake stroke.

5. An engine according to claim 4 wherein the means for keeping the lever arm against the cam is a spring which exerts a spreading force between the lever arm and the cam.

6. An engine comprising: a block having at least one cylinder; a piston movable axially in the cylinder through a power stroke and other strokes; a crankshaft rotatable in the block and including a crank arm and a crankpin with the crankpin being on the crank arm and offset from the axis of rotation for the crankshaft; linkage means between piston and the crankshaft for coupling the two together such that crankshaft rotates in a predetermined relation to the axial reciprocating movement of the piston in the cylinder, the linkage means including a lever arm, a piston connecting rod extended between the piston and the lever arm and being pivotally connected to the lever arm, and a crank connecting rod pivotally connected to the lever arm and to the crankpin of the crankshaft so as to be in offset relation to the axis of rotation for the crankshaft, and positioning means acting on the lever arm of the linkage means to position the linkage means such that a full stroke of the piston is translated into less than 180° of rotational movement for the crankshaft and the angle between the crank arm and the crank connecting rod is relatively large for the entire duration of the power stroke for the piston.

7. An engine comprising: a block having at least one cylinder therein; a piston movable axially in the cylinder through a power stroke and other strokes; a crankshaft rotatable in the block about a fixed axis of rotation and having a crank arm and a crankpin located on the crank arm such that it is offset from the fixed axis of rotation; a lever arm located between the piston and crankshaft; a piston connecting rod extended between the piston and the lever arm and being pivotally connected to both; a crank connecting rod extended between the crankpin on the crankshaft and the lever arm and being pivotally connected to both, the crank connecting rod being pivotally connected to the lever arm at a location offset from the location at which the piston connecting rod is connected to the lever arm; and a cam connected with and powered by the crankshaft, the cam bearing against the lever arm at a location offset from the pivotal connections of the piston and crank connecting rods to the lever arm, the cam being configured such that it causes the crank connecting rod to be at a relatively large angle with respect to the crank arm for the entire duration of the power stroke so that a force transmitted through the crank connecting rod is applied to the crank arm at a relatively large moment arm.

8. An engine according to claim 7 and further comprising means for positioning the linkage means generally laterally with respect to the axis of the cylinder.

* * * * *